US009109502B1

(12) United States Patent
Hall et al.

(10) Patent No.: US 9,109,502 B1
(45) Date of Patent: Aug. 18, 2015

(54) CONTROL SYSTEM FOR A SUPERCHARGER WITH A VARIABLE TRANSMISSION

(71) Applicant: Accessible Technologies, Inc., Lenexa, KS (US)

(72) Inventors: Cliff Hall, Grain Valley, MO (US); Damian Kuiper, Olathe, KS (US); Ken Jones, Kansas City, MO (US); Michael Carlson, Overland Park, KS (US); Ryan Konen, Olathe, KS (US)

(73) Assignee: Accessible Technologies, Inc., Lenexa, KS (US)

( * ) Notice: Subject to any disclaimer, the term of this patent is extended or adjusted under 35 U.S.C. 154(b) by 63 days.

(21) Appl. No.: 14/061,419

(22) Filed: Oct. 23, 2013

Related U.S. Application Data

(63) Continuation of application No. 14/052,135, filed on Oct. 11, 2013, now abandoned.

(51) Int. Cl.

| | |
|---|---|
| ***F02B 33/00*** | (2006.01) |
| ***F02B 33/44*** | (2006.01) |
| ***F02B 39/04*** | (2006.01) |
| ***F02B 39/16*** | (2006.01) |

(52) U.S. Cl.
CPC ..... *F02B 39/04* (2013.01); *F02B 39/16* (2013.01)

(58) Field of Classification Search
USPC ..... 60/598; 123/559.1, 559.3, 561, 564
See application file for complete search history.

(56) References Cited

U.S. PATENT DOCUMENTS

| | | | | |
|---|---|---|---|---|
| 4,938,732 | A * | 7/1990 | Krude | 474/53 |
| 2012/0000446 | A1* | 1/2012 | Venton-Walters et al. | 123/564 |
| 2012/0186565 | A1* | 7/2012 | Arima et al. | 123/559.1 |
| 2014/0277996 | A1* | 9/2014 | Pierik et al. | 701/102 |

FOREIGN PATENT DOCUMENTS

| | | | | |
|---|---|---|---|---|
| JP | 11132049 | A * | 5/1999 | F02B 37/00 |

* cited by examiner

*Primary Examiner* — Audrey K Bradley
(74) *Attorney, Agent, or Firm* — Hovey Williams LLP

(57) ABSTRACT

A supercharger assembly includes a centrifugal blower for delivering pressurized air to an engine air manifold of an engine; a variable transmission for driving the blower; a motor for adjusting a gear ratio of the variable transmission; and a control system for controlling operation of the motor to provide user selectable and/or programmable levels of supercharger boost. The control system may include a user input device for selecting a performance level of the supercharger assembly; at least one engine sensor for sensing an operating parameter of the engine; at least one environmental sensor for sensing a characteristic of the inlet air; and a programmable controller for controlling operation of the motor in accordance with the user selected performance level and outputs of the engine sensor and the environmental sensor.

15 Claims, 8 Drawing Sheets

| Engine Speed (RPM) | 500 | 1000 | 1500 | 2000 | 2750 | 3500 | 4500 | 5500 | 6500 | 7500 |
|---|---|---|---|---|---|---|---|---|---|---|
| Target Boost (PSI) | 0.25 | 1 | 2.5 | 5 | 7 | 7.8 | 8 | 8 | 8 | 8 |
| WOT CVT Ratio | 1.484 | 1.484 | 1.564 | 1.659 | 1.428 | 1.184 | 0.966 | 0.826 | 0.730 | 0.668 |
| Short Term Gain | 3 | 3 | 2.5 | 2.1 | 1.8 | 1.6 | 1.5 | 1.2 | 1 | 0.9 |
| Long Term Gain | 0.5 | 0.48 | 0.38 | 0.29 | 0.23 | 0.19 | 0.17 | 0.15 | 0.1 | 0.08 |
| Long Term Trim | 0.87 | 0.84 | 0.99 | 1.11 | 1.17 | 0.96 | 0.93 | 0.75 | 0.86 | 0.91 |

*Fig. 3.*

Partial Throttle Ratio Table (% of WOT Ratio)

| | Engine Speed RPM | | | | | | | | |
|---|---|---|---|---|---|---|---|---|---|
| Load | 500 | 1000 | 2000 | 3000 | 4000 | 5000 | 6000 | 7000 | 8000 |
| 1.0 | 1.000 | 1.000 | 1.000 | 1.000 | 1.000 | 1.000 | 1.000 | 1.000 | 1.000 |
| 0.9 | 0.746 | 0.803 | 0.873 | 0.897 | 0.922 | 0.947 | 0.973 | 0.994 | 0.999 |
| 0.8 | 0.595 | 0.661 | 0.763 | 0.802 | 0.849 | 0.896 | 0.951 | 0.985 | 0.996 |
| 0.7 | 0.504 | 0.559 | 0.666 | 0.716 | 0.777 | 0.841 | 0.908 | 0.962 | 0.976 |
| 0.6 | 0.446 | 0.487 | 0.584 | 0.638 | 0.707 | 0.779 | 0.856 | 0.917 | 0.935 |
| 0.5 | 0.405 | 0.434 | 0.513 | 0.567 | 0.637 | 0.710 | 0.788 | 0.847 | 0.868 |
| 0.4 | 0.371 | 0.393 | 0.454 | 0.505 | 0.574 | 0.648 | 0.727 | 0.783 | 0.807 |
| 0.3 | 0.340 | 0.360 | 0.404 | 0.449 | 0.517 | 0.589 | 0.667 | 0.720 | 0.747 |
| 0.2 | 0.310 | 0.330 | 0.364 | 0.401 | 0.467 | 0.536 | 0.610 | 0.659 | 0.687 |
| 0.1 | 0.280 | 0.303 | 0.330 | 0.361 | 0.422 | 0.487 | 0.552 | 0.591 | 0.618 |
| 0.0 | 0.250 | 0.275 | 0.303 | 0.330 | 0.385 | 0.440 | 0.495 | 0.523 | 0.550 |

*Fig. 5.*

NVH Adjusted CVT Ratio

| NVT Ratio | Engine Speed RPM | | | | | | | | |
|---|---|---|---|---|---|---|---|---|---|
| Load | 500 | 1000 | 2000 | 3000 | 4000 | 5000 | 6000 | 7000 | 8000 |
| 1.0 | 0.000 | 0.000 | 0.000 | 0.000 | 0.000 | 0.000 | 0.000 | 0.000 | 0.000 |
| 0.9 | 0.000 | 0.000 | 0.000 | 0.000 | 0.000 | 0.000 | 0.000 | 0.000 | 0.000 |
| 0.8 | 0.000 | 0.000 | 0.000 | 0.000 | 0.000 | 0.000 | 0.000 | 0.000 | 0.000 |
| 0.7 | 0.000 | 0.000 | 0.000 | 0.000 | 0.000 | 0.000 | 0.000 | 0.000 | 0.000 |
| 0.6 | 1.823 | 0.912 | 0.456 | 0.304 | 0.000 | 0.000 | 0.000 | 0.000 | 0.000 |
| 0.5 | 1.736 | 0.868 | 0.434 | 0.289 | 0.000 | 0.000 | 0.000 | 0.000 | 0.000 |
| 0.4 | 1.654 | 0.827 | 0.413 | 0.276 | 0.000 | 0.000 | 0.000 | 0.000 | 0.000 |
| 0.3 | 1.575 | 0.788 | 0.394 | 0.263 | 0.000 | 0.000 | 0.000 | 0.000 | 0.000 |
| 0.2 | 1.500 | 0.750 | 0.375 | 0.250 | 0.250 | 0.250 | 0.250 | 0.250 | 0.250 |
| 0.1 | 1.500 | 0.750 | 0.375 | 0.250 | 0.250 | 0.250 | 0.250 | 0.250 | 0.250 |
| 0.0 | 1.500 | 0.750 | 0.375 | 0.250 | 0.250 | 0.250 | 0.250 | 0.250 | 0.250 |

*Fig. 6.*

Path Weight Table

| | Engine Speed RPM | | | | | | | | |
|---|---|---|---|---|---|---|---|---|---|
| Load | 500 | 1000 | 2000 | 3000 | 4000 | 5000 | 6000 | 7000 | 8000 |
| 1.0 | 1.000 | 1.000 | 1.000 | 1.000 | 1.000 | 1.000 | 1.000 | 1.000 | 1.000 |
| 0.9 | 1.000 | 1.000 | 1.000 | 1.000 | 1.000 | 1.000 | 1.000 | 1.000 | 1.000 |
| 0.8 | 1.000 | 1.000 | 1.000 | 1.000 | 1.000 | 1.000 | 1.000 | 1.000 | 1.000 |
| 0.7 | 1.000 | 1.000 | 1.000 | 1.000 | 1.000 | 1.000 | 1.000 | 1.000 | 1.000 |
| 0.6 | 0.750 | 0.750 | 0.750 | 1.000 | 1.000 | 1.000 | 1.000 | 1.000 | 1.000 |
| 0.5 | 0.500 | 0.500 | 0.500 | 0.750 | 1.000 | 1.000 | 1.000 | 1.000 | 1.000 |
| 0.4 | 0.250 | 0.250 | 0.250 | 0.500 | 0.750 | 1.000 | 1.000 | 1.000 | 1.000 |
| 0.3 | 0.000 | 0.000 | 0.000 | 0.250 | 0.500 | 0.750 | 1.000 | 1.000 | 1.000 |
| 0.2 | 0.000 | 0.000 | 0.000 | 0.000 | 0.250 | 0.500 | 0.750 | 1.000 | 1.000 |
| 0.1 | 0.000 | 0.000 | 0.000 | 0.000 | 0.000 | 0.250 | 0.500 | 1.000 | 1.000 |
| 0.0 | 0.000 | 0.000 | 0.000 | 0.000 | 0.000 | 0.000 | 0.250 | 1.000 | 1.000 |

*Fig. 7.*

CONTROL SYSTEM FOR A SUPERCHARGER WITH A VARIABLE TRANSMISSION

RELATED APPLICATION

This is a continuation of U.S. application Ser. No. 14/052,135, filed Oct. 11, 2013, entitled CONTROL SYSTEM FOR A SUPERCHARGER WITH A VARIABLE TRANSMISSION, which is hereby incorporated by reference into the present application in its entirety.

BACKGROUND

Superchargers are often installed in vehicles and other machines with internal combustion engines to increase the engines' horsepower output. Superchargers increase the volume of air delivered to the cylinders of the engines during their intake cycles, thereby increasing the density or pressure of the air during the engines' compression and ignition strokes. Superchargers include air blowers or compressors that are driven directly or indirectly by their associated engines. Thus, as the speed of an engine increases, the speed of its supercharger proportionally increases. Due to the wide variation in engine speeds, typically from around 700 R.P.M. at idle to 8,000 R.P.M and higher at "red-line" acceleration, a supercharger also operates at wide variety of speeds.

High performance enthusiasts often wish to control the precise boost pressure of superchargers at different engine speeds to obtain desired engine power enhancements across all engine speeds. It is known to drive superchargers with continuously variable transmissions (CVTs) in order to provide a substantially constant drive speed to the superchargers. However, attempts to control CVTs to provide selectable supercharger drive speeds at different engine speeds have been mostly unsuccessful for a variety of reasons.

SUMMARY

The present invention solves the above-described problems and provides a distinct advance in the art of supercharger assemblies. More particularly, the present invention provides a control system for a CVT driven supercharger assembly for controlling the CVT to provide user selectable and/or programmable levels of supercharger boost at different engine speeds.

A supercharger assembly constructed in accordance with an embodiment of the invention broadly includes a centrifugal blower or compressor for delivering pressurized air to an intake manifold of an engine; a variable transmission for driving the blower; and a motor or other actuator for adjusting the variable transmission. The supercharger assembly also includes a control system for controlling operation of the motor or other actuator to provide user selectable and/or programmable levels of supercharger boost. One embodiment of the control system includes a user input device for selecting a desired performance level for the supercharger assembly; at least one engine sensor for sensing an operating parameter of the engine; at least one environmental sensor for sensing a characteristic of air before it is compressed by the blower; and a programmable controller for controlling operation of the motor in accordance with the user selected performance level and outputs of the engine sensor and the environmental sensor.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein:

FIG. 3 is a look-up table that may be accessed by the controller while performing the control sequence.

FIG. 5 is another look-up table that may be accessed by the controller of the supercharger assembly while performing the control sequence.

FIG. 6 is another look-up table that may be accessed by the controller of the supercharger assembly while performing the control sequence.

FIG. 7 is another look-up table that may be accessed by the controller of the supercharger assembly while performing the control sequence.

Figure 1:
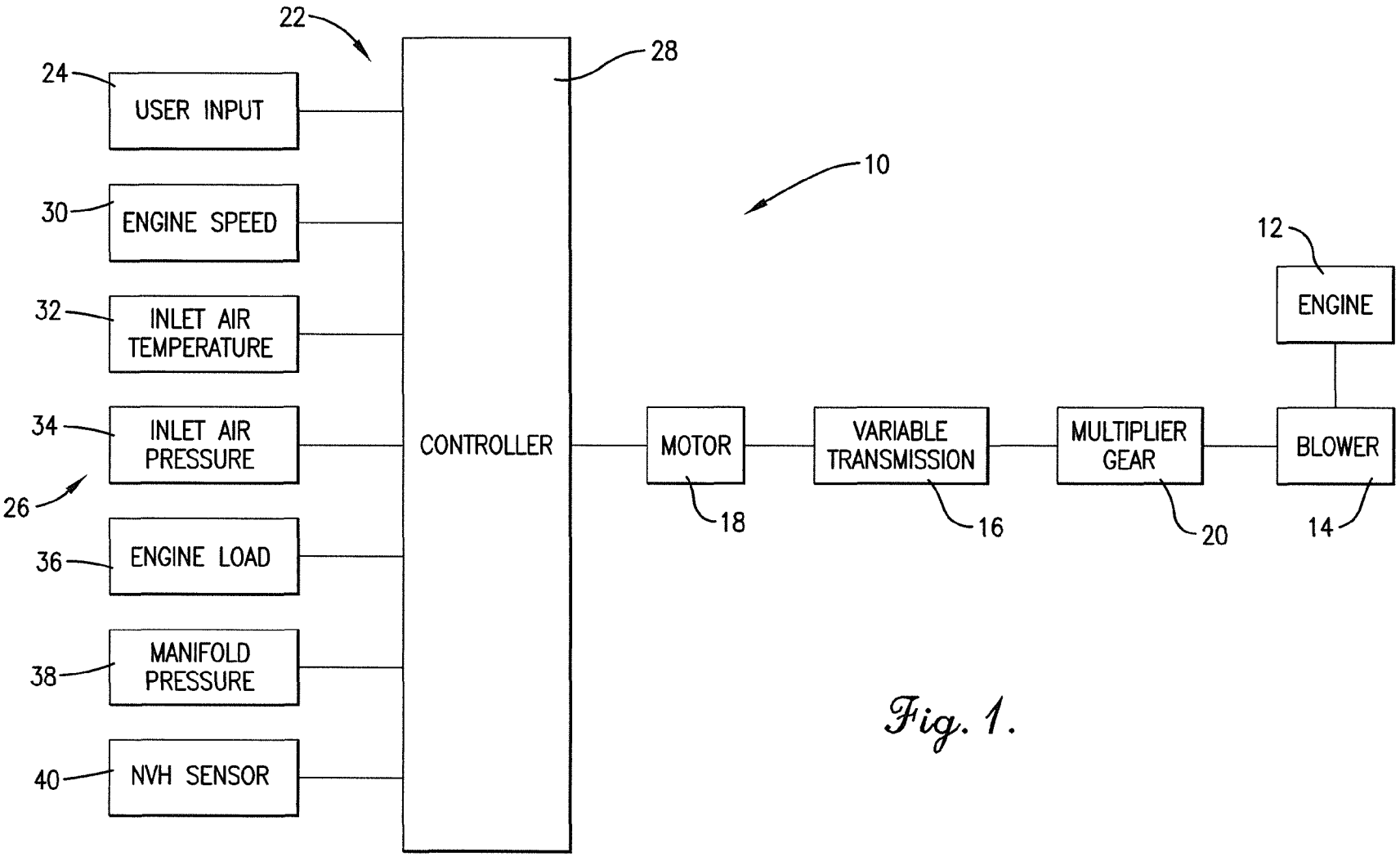
FIG. 1 is a block diagram of select components of a supercharger assembly constructed in accordance with embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, and initially FIG. 1, selected components of a supercharger assembly 10 constructed in accordance with embodiments of the present invention are illustrated. The supercharger assembly 10 may be used to provide pressurized air to the intake manifold of an internal combustion engine 12 and broadly includes a blower or compressor 14 for delivering pressurized air to the engine 12; a variable transmission 16 for driving the blower 14; a motor or other actuator 18 for adjusting the variable transmission; a speed multiplier gear assembly 20 for increasing the drive speed of the blower, and a control system 22 for controlling operation of the motor 18 to provide user selectable and/or programmable levels of supercharger boost. The supercharger assembly 10 may also include other conventional components which are not important for a thorough understanding of the present invention and which are therefore not described in detail herein. The supercharger assembly 10 may be used with any internal combustion engine but is particularly suited for engines used in cars, trucks, and other vehicles.

In more detail, the blower or compressor 14 may be any device that can pressurize air and deliver it to the intake manifold of the engine 12. For example, the blower may be a roots type device with a number of spinning, meshing lobes or a twin-screw device with rotating, meshing worm gears. In one particular embodiment of the invention, the blower 14 is a centrifugal type blower having an inlet for receiving inlet air, a rotatable impeller for accelerating the inlet air, a diffuser that surrounds the impeller and pressurizes the air, and an outlet for delivering the pressurized air to an intake manifold of the engine 12. The centrifugal blower may include other conventional components such as a volute. Pressurized air discharged from the blower outlet may flow through a discharge conduit, through an intercooler, and then to the intake manifold of the engine.

The variable transmission 16 is powered by the engine and drives the impeller of the blower 14. An embodiment of the variable transmission is a continuously variable transmission (CVT) that includes a variable diameter drive pulley with an input shaft for connecting to a drive belt of the engine, a variable diameter driven pulley with an output shaft for driving the blower impeller, and a transmission belt trained over the drive pulley and the driven pulley. Embodiments of the drive pulley and the driven pulley may each comprise a pair of opposing truncated cones or frustoconical sections defining an angular groove therebetween. One of the cones of each pulley may be moved by the motor 18 or other actuator while the other remains fixed. Moving one cone in relation to the other varies the effective diameter of the pulley and thus the speed of the CVT belt. Consequently, CVT belt speed is a function of the effective diameter of the drive pulley and driven pulley which are, in turn, a function of the axial position of the cones relative to each other.

The CVT belt fits between the opposing cones of the variable diameter drive and driven pulleys as described above. An embodiment of the CVT belt is a conventional V-belt with a cross-section of an isosceles trapezoid. To avoid belt slippage while transferring torque from the drive pulley to the driven pulley, the cones of the driven pulley may be biased axially inwardly to squeeze against the sidewalls of the CVT belt.

The motor 18 adjusts the drive pulley and/or the driven pulley to adjust a gear ratio of the CVT and hence the rotational speed of the driven pulley and the impeller of the blower. The motor 18 may, for example, slide or otherwise move the moveable cone of the drive pulley and/or driven pulley. The motor 18 may be any actuator capable of moving the drive pulley and/or the driven pulley of the CVT as described above. An embodiment of the motor 18 is an electric, brushless DC motor that is driven by a proportional derivative controller operable to apply pulse width modulated current pulses to the motor to cause the motor to move the drive pulley and/or driven pulley.

The speed multiplier gear assembly 20 is connected between the variable transmission 16 and the blower 14 for increasing rotational speed of the blower impeller. The speed multiplier gear 20 is needed because the blower must spin at a higher rotational speed than the CVT is capable of generating. The speed multiplier gear is therefore installed between the driven pulley of the CVT and the input shaft of the blower to multiply the rotational speed of the blower impeller.

Examples of particular variable transmissions, speed multiplier gears, and related components that may be used with the present invention are described in more detail in U.S. Pat. Nos. 8,439,019 and 8,439,020, both of which are incorporated by reference into the present application in their entireties. However, the present invention is not limited to any particular variable transmission design, as the control system 22 may be used with any supercharger.

In accordance with an important aspect of the present invention, the control system 22 controls operation of the motor 18 and thus actuation of the variable transmission 16 to provide user selectable and/or programmable levels of supercharger boost. One embodiment of the control system 22 is shown in FIG. 1 and includes a user input device 24 for selecting a performance level of the supercharger assembly; a number of sensors 26 for sensing operating parameters of the engine 12 and/or environmental characteristics of air introduced into the engine; and a programmable controller 28 for controlling operation of the motor in accordance with the user selected performance level and outputs of the sensors.

The user input 24 may be any device that permits a user to select a performance level of the supercharger assembly 10. For example, the user input 24 may be a selector switch, a touchscreen display, a plurality of buttons or knobs, or any other similar device or combination of devices. One particular embodiment of the user input 24 is a touch screen display that allows a user to select between Touring, Sport, Competition, and Custom performance modes, each of which provides a unique level of supercharger boost.

In one embodiment, the sensors 26 include an engine speed sensor 30, an inlet air temperature sensor 32, an inlet air pressure sensor 34, an engine load sensor 36, an intake manifold pressure sensor 38, and one or more engine noise, vibration, and harshness (NVH) sensors 40. These and other possible sensors may be dedicated sensors provided with the supercharger assembly 10 or may be sensors that already exist in the vehicle in which the engine 12 is mounted.

The engine speed sensor 30 senses or measures the engine's speed, hereafter expressed in revolutions per minute (RPMs), and provides a corresponding signal or data to the controller 28. As mentioned above, the sensor 30 may be a dedicated stand-alone sensor or may be an existing vehicle engine speed sensor. Engine speed may also be calculated as a function of the speed of the variable transmission 16 drive pulley.

The inlet air temperature sensor 32 measures the temperature of air before it is drawn into and compressed by the blower 14 and provides a corresponding signal or data to the controller 28. The sensor may be a dedicated stand-alone thermostat or other similar device placed in or near the blower inlet, or blower inlet temperature can be approximated with the vehicle's ambient air temperature sensor.

The inlet air pressure sensor 34 measures the pressure of the air before it is drawn into and compressed by the blower 14 and provides a corresponding signal or data to the controller 28. The sensor may be a dedicated stand-alone pressure transducer placed in or near the blower inlet, or blower inlet pressure can be approximated by determining the engine's manifold pressure before the engine is started.

The engine load sensor 36 determines the throttle position or pedal position of the vehicle in which the engine 12 is mounted and provides a corresponding signal or data to the controller 28. The engine load sensor is preferably an existing sensor in the vehicle and can sense throttle positions between an idle position and a wide open throttle position. As used herein, the term "wide open throttle" and its abbreviation WOT means the engine is being operated at its maximum throttle position. "Partial throttle" is any throttle position less than WOT.

The manifold pressure sensor 38 measures the pressure of the air after is has been compressed and discharged from the blower and provides a corresponding signal or data to the controller 28. This sensor 38 may be a dedicated stand-alone sensor placed in the blower outlet or an existing sensor in the vehicle's intake manifold.

The engine noise, vibration, and harshness (NVH) sensors sense or monitor sounds, vibrations, and other engine conditions that could be annoying to drivers or others and provides a corresponding signal or data to the controller 28. These sensors may be microphones, accelerometers, and other similar devices and are described in more detail below.

The controller 28 receives signals, data, or other inputs from the user input 24 and the sensors 26 as well as other information discussed below and generates and sends a signal to the motor 18 for adjusting the variable transmission 16 in an attempt to provide user selectable and/or programmable levels of supercharger boost. The controller 28 may include any number and type of electronic hardware, firmware, and/or software devices including processors, application specific integrated circuits, or other logic devices and my be coupled with internal or external memory elements.

Aspects of the invention may be implemented with one or more computer programs stored in or on computer-readable medium residing on or accessible by the controller 28. Each computer program preferably comprises an ordered listing of executable instructions for implementing logical functions in the controller. Each computer program can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. In the context of this application, a "computer-readable medium" can be any non-transitory means that can store the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

Figure 2:
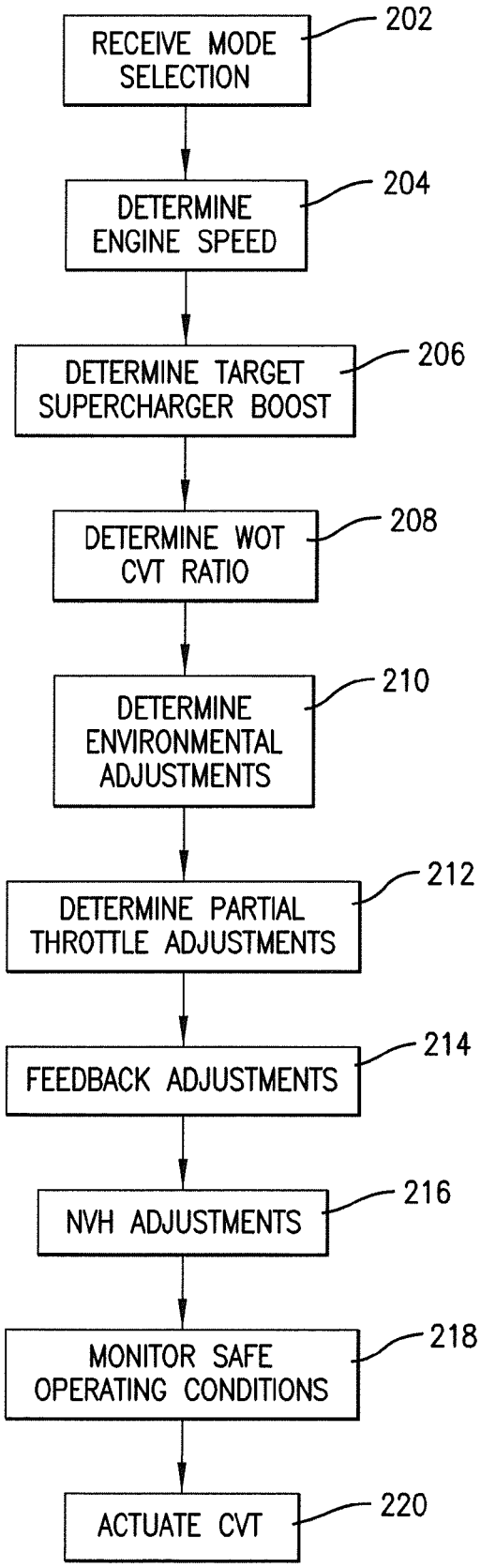
FIG. 2 is a flow diagram depicting steps in a control sequence performed by the controller of the supercharger assembly.

The flow chart of FIG. 2 shows the functionality and operation of an implementation of the present invention in more detail. In this regard, some of the blocks of the flow chart may represent method steps or portions of code of the computer programs of the present invention. In some alternative implementations, the functions noted in the various blocks may occur out of the order depicted in FIG. 2. For example, two blocks shown in succession in FIG. 2 may in fact be executed substantially concurrently, or the blocks may sometimes be executed in the reverse order depending upon the functionality involved.

In one exemplary control sequence, the controller 28 first receives an indication of the desired supercharger performance mode from the user input device 24 as depicted in box 202. As mentioned above, the user input device 24 may allow a user to select between Touring, Sport, Competition, and Custom performance modes, each of which provides a unique levels of supercharger boost. The present invention is not limited to these exemplary performance modes, as the controller 28 may implement any number of performance modes. The exact supercharger boost for each performance mode varies from engine to engine and is dependent on engine speed and other variables as discussed below. Because a nearly limitless number of supercharger boost levels can be provided by the control system of the present invention, the description below only provides one exemplary supercharger boost level for one exemplary engine being operated in one exemplary performance mode.

The controller 28 next receives signals, data, or other information representative of the engine's current speed as depicted in box 204. Although this is shown as a discrete step in the control sequence, the controller may periodically or constantly monitor the engine speed.

The controller 28 then calculates or otherwise determines a target supercharger boost pressure 206 for the current speed of the engine as depicted in box 206. The target boost pressure is the amount of pressurized air, measured in pounds per square inch (psi), that must be delivered to the engine's intake manifold in order to achieve a desired boost in performance of the engine 12. The target boost pressures for various different engines and engine speeds may be empirically determined in accordance with the desired performance mode of the supercharger.

In one embodiment of the invention, the controller 28 obtains the target supercharger boost pressure from a look-up table. A number of look-up tables may be created for a particular engine, each of which contains target boost levels and other dependent variables for various different speeds of the engine. Each look-up table may correspond to one mode of operation of the supercharger assembly, such as the Touring, Sport, Competition, and Custom performance modes discussed above.

An exemplary look-up table is shown in FIG. 3. The look-up table includes a number of engine speeds as independent variables and a number of other values that are dependent on the engine speed. The particular values shown in the look-up table are examples only and may be changed without departing from the scope of the invention.

The illustrated look-up table includes engine speeds between 500 and 7,500 RPMs in 500 RPM increments. Values that fall between the listed increments may be interpolated. The look-up table may include any ranges of engine speeds in any increments. For example, if more precise supercharger control is desired, the table may provide engine speeds in increments of 250 or even 100 RPMs.

One of the dependent variables in the look-up table is target boost pressure measure in pounds per square inch (psi). This represents the amount of supercharger boost needed to achieve a desired engine performance for each increment of engine speed. For example, the table shows that a target boost of 0.25 psi is desired for an engine speed of 500 RPMs and a target boost of 8 psi is desired for an engine speed of 7500 RPMs. Again, these target boost pressures are empirically determined based on many different factors and are different for different engines and/or different performance modes for the same engine.

Another dependent variable in the look-up table is a wide open throttle (WOT) continuously variable transmission (CVT) ratio. This represents the positioning of the variable transmission 16 needed to achieve each desired target boost pressure under a given set of environmental conditions. In one embodiment, the WOT CVT ratio is the speed of the variable transmission's driven or output pulley divided by the speed of the variable transmission's drive or input pulley needed to obtain a desired amount of supercharger boost. For example, the table shows that a WOT CVT ratio of 1.484 is required to provide 0.25 psi of supercharger boost at an engine speed of 500 RPMs. In one embodiment, the WOT CVT ratio varies between about 0.6 (relatively slower driven or output pulley speed) and 1.5 (relatively faster driven or output pulley speed).

Another dependent variable in the look-up table is a short term gain coefficient. This is an empirically determined constant used in a short term boost feedback loop described below. In the illustrated look-up table, the short term gain ranges from 3 to 0.9, but other values may be used without departing from the scope of the invention.

Another dependent variable in the look-up table is a long term gain coefficient. This is an empirically determined constant used in a long term boost feedback loop described below. In the illustrated look-up table, the long term gain ranges from 0.5 to 0.08, but other values may be used without departing from the scope of the invention.

Another dependent variable in the look-up table is a long term trim coefficient. These are "learned" values for the long term boost feedback loop and are used as multipliers for the WOT CVT ratio as explained below.

Returning to FIG. 2, the controller 28 accesses the above-described look-up table to determine a target boost pressure for a given engine speed in box 206. For example, if the controller 28 receives an input from the engine speed sensor 30 indicating an engine speed of 1,000 RPM in box 204, the controller 28 accesses the look-up table and determines the target boost for this sensed engine speed is 1 psi.

The controller 28 next calculates or otherwise determines the WOT CVT ratio needed to obtain the target supercharger boost pressure as depicted in box 208. Again, in one embodiment of the invention, the controller 28 obtains the WOT CVT ratio from a look-up table such as the one shown in FIG. 3. Using the same exemplary engine speed as the previous paragraph, the controller accesses the look-up table and determines the desired WOT CVT ratio is 1.484.

At this point, the controller 28 could operate the motor 18 to position the variable transmission 16 according to the WOT CVT ratio obtained in box 208. However, because the blower impeller speed (and hence the WOT CVT ratio) necessary to obtain a given supercharger boost for a given engine speed varies with certain environmental conditions such as ambient air temperature, pressure, and humidity, more accurate control of the variable transmission 16 can be obtained if the WOT CVT ratio is adjusted for these environmental conditions as shown in box 210.

The most important environmental condition to correct for is blower inlet air temperature as this can change significantly from one period of use to the next. Ambient air pressure can change dramatically as well (especially with elevation) but is generally not significant while a vehicle is parked. Therefore, the long term trims discussed are gradually learned while the vehicle is being driven through an elevation change. Humidity is less important and not accounted for in the exemplary equations below.

In one embodiment, the controller adjusts the WOT CVT ratio obtained in box 208 to account for these environmental conditions by obtaining sensed inlet air temperature and pressure values from the sensors 32, 34 and calculating an environmental condition multiplier that is then multiplied by the WOT CVT ratio to obtain an environmentally adjusted WOT CVT ratio. The environmentally adjusted WOT CVT ratio may be calculated with the following equations:

$$\text{Speed Correction Factor due to Temperature: } (N/N_{reference\ temperature})=[(T_{Inlet})/(T_{Reference})]\hat{}(0.5)$$

where:

T is Temperatures is expressed in absolute units

N represents impeller speed in RPM $$\text{Speed Correction Factor due to Inlet Pressure: } (N/N_{reference\ pressure})=[(p_{reference})/(p_{inlet})]\hat{}(0.5)$$

$$\text{Environmentally Adjusted WOT CVT Ratio}=(\text{WOT CVT Ratio})*(N/(N_{reference\ temperature})*(N/N_{reference\ pressure})$$

The controller 28 next considers whether the environmentally adjusted WOT CVT ratio should be adjusted for the current engine load as depicted in box 212. This is done whenever the engine load sensor 36 determines that the engine 12 is being operated at less than 100% power, or at a partial throttle level. The purpose of the partial throttle adjustment is to reduce the blower's impeller speed (via reduced CVT ratio) under conditions of reduced engine load (throttle position or pedal position are frequently used interchangeably with engine load).

For a typical spark ignition engine, throttling is used to reduce engine power by reducing the airflow through the engine. Air flow and fuel flow are matched so a reduction in air yields a reduction in fuel, which yields a reduction in power output. Throttling airflow results in a pressure loss across the throttle, yielding a reduced pressure. This is undesirable for two primary reasons. First, there is no value in substantially raising the air pressure delivered by the supercharger assembly 10 to the throttle only to then throttle it and reduce the pressure. Any blower impeller speed higher than that necessary to deliver the required airflow is excessive and costs in terms of fuel efficiency. Second, attempting to regulate actual manifold pressure in a throttled system is both difficult and pointless. The supercharger only needs to deliver consistent, predictable airflow to the engine and the output will be regulated with the throttle. Any attempt to regulate the partial throttle engine power output via the blower speed will partially override the throttle and yield an unpredictable engine response.

Thus, under partial throttle conditions, the controller 28 attempts to maintain a minimum blower speed subject to the following conditions:

1. Maximum airflow deliverable at a given impeller speed must be equal to or greater than that needed by the engine. This ensures that the blower is not a restriction to the engine.

2. Boost responsiveness is maintained.

Figure 4:
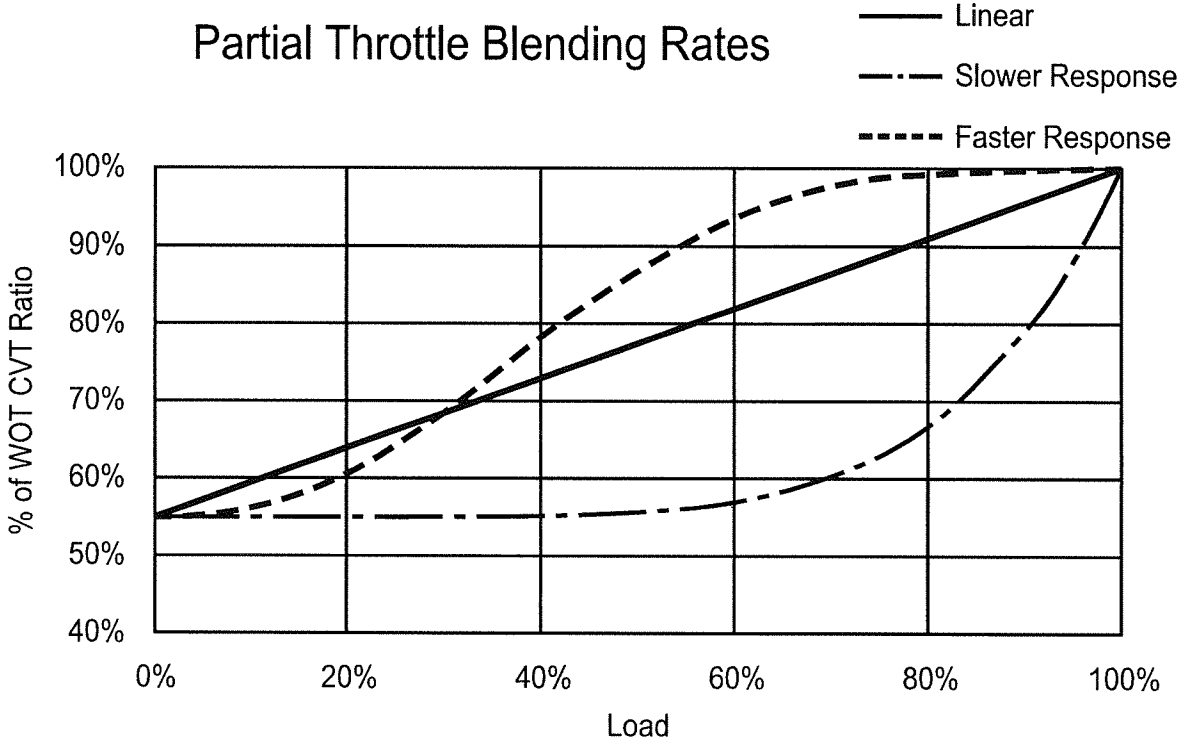
FIG. 4 is a graph of various different partial throttle blending rates that may be implemented by the controller while performing the control sequence.
Figure 8:
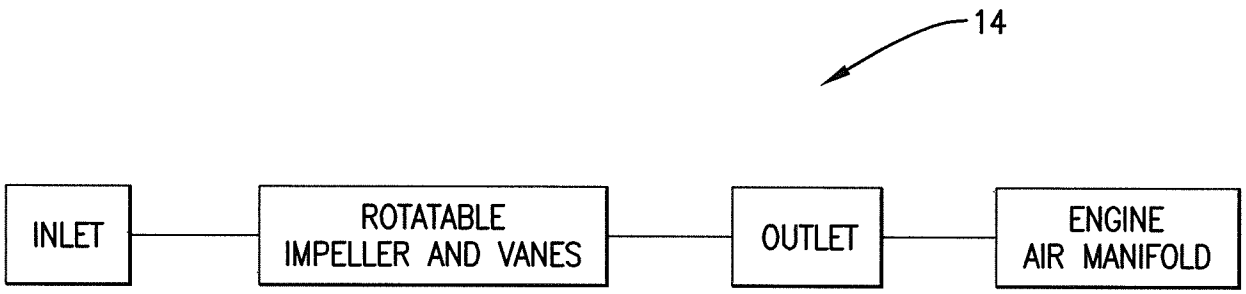
FIG. 8 is a block diagram illustrating components of an exemplary blower of the supercharger assembly.
Figure 9:
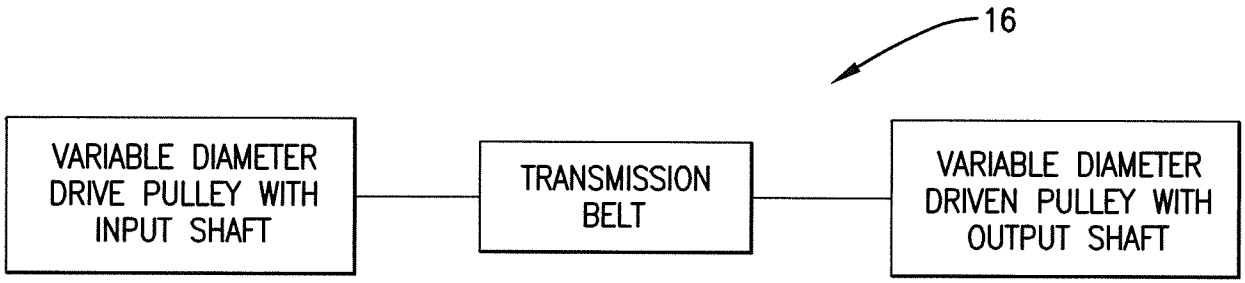
FIG. 9 is a block diagram illustrating components of an exemplary variable transmission of the supercharger assembly.

As for the second condition, keeping the CVT ratio at an absolute minimum until full throttle and then switching to the desired CVT ratio (which could be substantially larger than the minimum CVT ratio) results in a time lag before the desired CVT ratio is achieved. Depending on the difference between minimum CVT ratio and desired CVT ratio, this time lag could be excessive. Therefore, an embodiment of the invention blends the desired CVT ratio from a minimum at low load to the desired CVT ratio at high load (or full throttle). The blending should be smooth so that throttle response is natural and predictable. The rate at which this blending occurs can be tailored to optimize economy or response. The blending rate can be selected from several predetermined maps by the driver via the user input 24. The blending can be dynamically determined and adjusted by ascertaining the driver's intent where a more aggressive driving intent as indicated by rapid changes in throttle position (or pedal position), higher than normal engine speeds for the driving condition, or large lateral accelerations, among other indicators. Similarly, the recent history of these parameters could be rewarded with increased rate of partial throttle blending in order to maximize boost response. Exemplary partial throttle blending rates for three different operating modes are graphed in FIG. 4. A look-up table with partial throttle ratios is shown in FIG. 5.

Once partial throttle conditions are accounted for, the controller 28 next adjusts the WOT CVT ratio in accordance with short term and long term feedback loops as depicted in box 214. The blower impeller speed necessary to generate a given manifold pressure will vary based on many factors. Some of these factors are modeled and predicted based on theoretically based relationships (environmental corrections discussed above). Others, such as a charging restriction of an air filter due to accumulating dirt, are simply corrected in a feedback type system. An embodiment of the present invention uses two types of feedback:

- A short term feedback loop, which simply looks at where the boost was verses where it was supposed to be and adjusts speed appropriately. Short term feedback can only be applied under Wide Open Throttle (WOT) conditions.
- A long term feedback loop, which learns the trims (or adjustments) necessary to achieve the target boost as a function of engine speed. This yields a learned and stored set of values which can be applied under WOT and partial throttle conditions.

Short term feedback is a multiplier based on measured verses desired performance from the previous control loop iteration applied to the next control loop iteration. Short term feedback is only active during WOT operation (as defined by a pre-determined high load condition). Generally speaking, an increase in blower speed will result in an increase in boost. The sensitivity of this response is a function of impeller speed and engine characteristics, therefore the short term feedback gain used should be a function of engine speed. It is also helpful to more accurately model the relationship between impeller speed and pressure ratio:

$$\text{Short Term Trim}=(N_{adjusted}/N_{actual})=(P_{target}/P_{actual})^{\wedge}(0.5).$$

Where N represents impeller speed in RPM and P represents boost pressure in absolute units of pressure.

With the feedback gain accounting for both compressor speed and engine speed, fairly aggressive feedback parameters can be used with good stability and reasonable convergence is expected within several tenths of a second.

Long term feedback is a learned (and remembered) value that is stored as a function of engine speed. Basically it is a relaxed recording of the short term feedback trims necessary at a given engine speed that were necessary to achieve the desired manifold pressure.

Both the short term and long term feedback gain values are stored in the WOT ratio look-up table shown in FIG. 3. Functionally speaking, the long term gain is a relaxed value of the short term trim added to the current long term trim at any given engine speed. A fully mature set of long term trims would result in the short term feedback term being unity. The long term trims are expected to achieve reasonable convergence in a matter of several seconds, about 1 order of magnitude slower than the short term trim. This long term trim feature allows the learning of WOT ratio table for an unknown application with very little knowledge of engine airflow requirements. Long term trim learning is only active during WOT operation, similar to short term feedback. Use of learned long term trims can be applied under part throttle conditions.

$$(\text{Long Term Trim})_{new}=(\text{Long Term Trim})_{current}+(\text{Long Term Gain})*(\text{Short Term Trim})_{current}$$

The long term trim value is associated with the current engine speed (for example, 3699 rpm) and needs to be applied to the WOT Ratio Look-Up Table at the appropriate engine speeds of the table (for example 3500 rpm & 4500 rpm) This is accomplished using lever rule as follows:

$$LT_{3500}=(4500-N_{LT})/(4500-3500)*(\text{Long Term Trim})_{new}$$

$$LT_{4500}(N_{LT}-3500)/(4500-3500)*(\text{Long Term Trim})_{new}$$

At this point, the controller 28 has all the information necessary to determine the desired CVT Ratio via the WOT CVT ratio with feedback path:

$$(\text{Desired CVT Ratio})_{WOT\ Table\ wall\ Feedback}=(\text{WOT CVT Ratio})*(\text{Long Term Trim})*(\text{Environmental Condition Multiplier})*(\text{Part Throttle Ratio})*(\text{Short Term Trim})$$

However, at low loads and engine speeds such as idle or cruising on the highway, it may be desirable to optimize the blower impeller speeds for noise, vibration, & harshness (NVH) considerations. Some blower speeds may excite certain vehicle and/or engine vibration harmonics that cause distracting sounds and/or excessive vibration that can reduce the life of some mechanical components. Thus, it may be desirable to operate the blower at lower speeds to minimize these vibrations. Note that blower speeds for NVH consideration need to be absolute, that is, they won't change for environmental conditions or boost feedback and will thus need to be determined separately from the WOT CVT ratio with feedback path and the two blended together appropriately. Compressor speeds for NVH considerations can be determined in 2 ways:

1. NVH speeds that cause NVH concerns can be experimentally pre-determined at the factory or by a skilled tuner and then stored for later access by the controller 18.

2. Alternatively, the NVH sensors 40, which may include microphones and/or accelerometers, could be used to measure noise and/or vibration and fed back into the controller 28, which in turn adjusts the blower impeller speed (within a pre-defined range) to minimize noise and/or acceleration. Note that acceleration, with regard to NVH, refers to vibration strength as measured with an accelerometer, not longitudinal or lateral acceleration of the vehicle.

The controller adjusts the CVT ratio for NVH considerations in box 216. To adjust the CVT Ratio for NVH considerations, an absolute ratio table such as the one shown in FIG. 6 can be used. Alternatively, active sensors can be used to tune the blower speed, within limits to achieve minimum NVH. In the case of feedback NVH sensors, 2 tables similar to the one in FIG. 6 may be used, where one is populated with lower CVT ratio limits and the other is populated with upper CVT ratio limits.

Sometimes it may be desirable to ignore the NVH considerations and only use the CVT ratio with feedback values. For example, when accelerating at full throttle, it may be desirable to ignore the environmental conditions for performance reasons. FIG. 7 illustrates a path weight table that indicates when a NVH adjusted CVT ratio should be used. A path weight of 1 in the table indicates that the WOT CVT ratio should be used without adjusting for NVH, and a path weight of 0 indicates that the NVH adjusted CVT ratio should be used. Values between 0 and 1 indicate a blending of the two should be used in accordance with the following formulas:

$$(\text{Desired CVT Ratio})_{weighted}=(\text{Path Weight})*(\text{Desired CVT Ratio})_{WOT\ Table\ with\ Feedback}+(1-\text{Path Weight})*(\text{NVH Ratio})$$

The controller 28 next ensures the supercharger assembly 10 is being operated within safe operating limits as shown in box 218. In one embodiment, the controller 28 monitors inputs such as engine speed, impeller speed, crankshaft input pulley speed, CVT ratio, and manifold pressure to ensure that performance of the supercharger is within safe operating conditions for the engine. If the inputs to the controller 28 exceed arbitrary thresholds, the control system 22 will move the CVT ratio to a safe operating level in order to prevent potential damage to the engine.

Engine speed is a direct contributor to blower impeller speed. The controller 28 takes the derivative of the engine speed input in order to derive an engine acceleration value. It is necessary that the CVT ratio be capable to match the rate of change of the engine speed in order to produce the necessary impeller speed. Situations such as tire slippage or automatic transmission downshifts can present an excessive rate of engine acceleration. This rate of engine acceleration may exceed the motor's capability to maintain a desired impeller speed. For extreme engine accelerations, the controller 28 may implement a predictive ratio control method. Once the engine acceleration exceeds a known threshold the predictive control algorithm is activated. This predictive control algorithm employs a look forward approach in which it predicts where the CVT ratio needs to be in the future based upon engine acceleration. The control system uses this predicted ratio as the target ratio in order to achieve the desired impeller speed during excessive engine acceleration.

The controller 28 then activates the motor 18 to position the variable transmission to achieve the desired level of supercharger boost in box 220. The control system 22 controls the CVT ratio electro-mechanically by applying a force through the motor 18 to the input sheave of the variable transmission in order to achieve the desired target ratio.

The CVT motor actuator 18 is electro-mechanically controlled using a proportional derivative (PD) controller. This PD controller takes the target ratio along with measured ratio input, and applies power to the CVT actuator in the corresponding direction so that the measured ratio will move to the target ratio.

Due to systematic friction, the CVT ratio can be somewhat difficult to move. The present invention employs an electronically controlled stiction compensation strategy to compensate for this stiction. This strategy is not the same pulse width modulated approach used during normal operation. Within this stiction compensation strategy, a constant current is applied to the motor using discrete current pulses. The magnitude of these pulses does not vary, only the frequency and duration at which these pulses are applied, similar to tapping on a wrench with a hammer to get a sticky bolt to turn. As the motor begins to overcome the systematic friction, the frequency of the pulses is reduced and a transition to normalized CVT actuator control is deployed.

Although the invention has been described with reference to the embodiments illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A supercharger assembly for delivering pressurized air to an internal combustion engine, the supercharger assembly comprising:

a centrifugal blower including an inlet for receiving air, a rotatable impeller and vanes for pressurizing the air, and an outlet for delivering the pressurized air to an engine air manifold of the engine;

a variable transmission for driving the impeller of the blower, the variable transmission including— a variable diameter drive pulley with an input shaft for directly or indirectly connecting to an engine, a variable diameter driven pulley with an output shaft for driving the impeller of the centrifugal blower, a transmission belt trained over the drive pulley and the driven pulley;

a motor for adjusting at least one of the drive pulley or the driven pulley to adjust a gear ratio of the variable transmission;

a programmable controller for controlling operation of the motor in accordance with user selectable inputs and sensed operating parameters of the engine to control a boost performance of the supercharger assembly; and a speed multiplier gear assembly connected between the variable transmission and the blower for increasing rotational speed of the blower impeller.

2. The supercharger assembly of claim 1, wherein the variable transmission is a continuously variable transmission.

3. The supercharger assembly of claim 1, wherein the motor is an electric DC motor.

4. The supercharger assembly of claim 3, wherein the controller includes a proportional derivative controller that applies pulse width modulated current pulses to the motor to cause the motor to move the drive pulley or driven pulley.

5. The supercharger assembly of claim 1, further including at least one engine sensor for sensing an operating parameter of the engine and at least one environmental sensor for sensing a characteristic of the air, wherein the controller is responsive to the engine sensor and the environmental sensor to control operation of the motor partially as a function of the operating parameter of the engine and the characteristic of the air.

6. The supercharger assembly of claim 5, wherein the environmental sensor is a temperature sensor that senses or measures a temperature of the air.

7. The supercharger assembly of claim 5, wherein the engine sensor is an engine speed sensor that senses or measures a speed of the engine.

8. The supercharger assembly of claim 7, wherein the environmental sensor is a pressure sensor that senses or measures a pressure of the air.

9. A supercharger assembly for delivering pressurized air to an internal combustion engine, the supercharger assembly comprising:

a centrifugal blower including an inlet for receiving air, a rotatable impeller for pressurizing the air, and an outlet for delivering the pressurized air to an engine air manifold of the engine;

a variable transmission for driving the impeller of the blower, the variable transmission including— a variable diameter drive pulley with an input shaft for directly or indirectly connecting to an engine, a variable diameter driven pulley with an output shaft for driving the impeller of the centrifugal blower, a transmission belt trained over the drive pulley and the driven pulley;

a speed multiplier gear assembly connected between the variable transmission and the blower for increasing rotational speed of the blower impeller;

a motor for adjusting at least one of the drive pulley or the driven pulley of the variable transmission to adjust a gear ratio of the variable transmission; and a user input device that permits a user to select a performance level of the supercharger assembly;

at least one engine sensor for sensing an operating parameter of the engine;

at least one environmental sensor for sensing a characteristic of the air; and a programmable controller for controlling operation of the motor in accordance with the user selected performance level and outputs of the engine sensor and the environmental sensor.

10. The supercharger assembly of claim 9, wherein the variable transmission is a continuously variable transmission.

11. The supercharger assembly of claim 9, wherein the motor is an electric DC motor.

12. The supercharger assembly of claim 9, wherein the programmable controller includes a proportional derivative controller operable to apply pulse width modulated current pulses to the motor to cause the motor to move the drive pulley or driven pulley.

13. The supercharger assembly of claim 9, wherein the engine sensor is an engine speed sensor that senses or measures a speed of the engine.

14. The supercharger assembly of claim 9, wherein the environmental sensor is a temperature sensor that senses or measures a temperature of the air.

15. The supercharger assembly of claim 9, wherein the environmental sensor is a pressure sensor that senses or measures a pressure of the air.

* * * * *